US006682247B1

(12) United States Patent
Castillo et al.

(10) Patent No.: US 6,682,247 B1
(45) **Date of Patent: *Jan. 27, 2004**

(54) DRAWABLE AND/OR TRACEABLE CARRIERS

(75) Inventors: Arthur G. Castillo, Chino Hills, CA (US); Norman Yamamoto, Yorba Linda, CA (US); Chitto R. Sarkar, Brea, CA (US); Christine Kay Landis, Irvine, CA (US); Frank Yen-Jer Shih, Arcadia, CA (US); Zhisong Huang, San Dimas, CA (US)

(73) Assignee: Avery Dennsion Corporation, Pasadena, CA (US)

( * ) Notice: Subject to any disclaimer, the term of this patent is extended or adjusted under 35 U.S.C. 154(b) by 181 days.

This patent is subject to a terminal disclaimer.

(21) Appl. No.: 09/679,938

(22) Filed: Oct. 5, 2000

Related U.S. Application Data

(63) Continuation-in-part of application No. 09/607,996, filed on Jun. 30, 2000.

(51) Int. Cl.[7] ..... B42F 13/00

(52) U.S. Cl. ..... 402/73; 40/771; 206/459.5; 224/153; 224/158; 281/15.1; 281/22; 281/29; 402/4; 402/80 R; 434/410

(58) Field of Search ..... 281/15.1, 22, 29, 281/31; 401/292; 402/4, 70, 73, 74, 75, 76, 77, 78, 80 R; 434/410; 224/158, 153; 206/459.5; 40/771; 428/195

(56) References Cited

U.S. PATENT DOCUMENTS

| | | | |
|---|---|---|---|
| 854,710 | A | 5/1907 | Barker |
| 1,510,110 | A | 9/1924 | Schmidt |
| 2,120,739 | A | 6/1938 | Meadows |
| 2,335,739 | A | 11/1943 | Chamberlin |
| 2,527,530 | A | 10/1950 | Cassel |
| 2,556,825 | A | 6/1951 | Smith |
| 2,583,403 | A | 1/1952 | Wiser |
| 2,879,609 | A | 3/1959 | Watkins |
| 2,908,658 | A | 10/1959 | Granlich et al. |
| 3,083,988 | A | 4/1963 | Hertelendy |
| 3,158,525 | A | 11/1964 | Reynolds |
| 3,257,128 | A | 6/1966 | Schneider |
| 3,565,462 | A | 2/1971 | Gottlieb |
| 4,139,965 | A | 2/1979 | Curry et al. |

(List continued on next page.)

FOREIGN PATENT DOCUMENTS

| | | |
|---|---|---|
| EP | 0 199 874 A1 | 5/1985 |
| EP | 0 705 704 A2 | 10/1996 |
| EP | 0 655 346 B1 | 9/1998 |
| WO | WO 96/18496 | 6/1996 |
| WO | WO 97/01448 | 1/1997 |
| WO | WO 99/04981 | 2/1999 |
| WO | 02/102186 | * 12/2002 |

*Primary Examiner*—Monica S. Carter
(74) *Attorney, Agent, or Firm*—Oppenheimer Wolff & Donnelly LLP

(57) ABSTRACT

The cover of a binder or album is provided with a coating which is receptive to inks which are water based, solvent based or gel based, and which is substantially water-fast after the ink has dried. A coated transparent or translucent sheet may be provided on the front cover of the binder to form a pocket so that visual material inserted in the pocket may be traced, and so that the cover may be personalized. The coating may include finely divided porous particulates and a binder which includes as a component a water soluble polymer. The coating may be applied to backpacks, zippered binders, and pencil pouches, and to the transparent sheet material overlying photographs mounted in a photo album. Personalized writing or designs may be written or drawn onto the coated products using ink pens of virtually any type.

27 Claims, 4 Drawing Sheets

U.S. PATENT DOCUMENTS

| | | | | | |
|---|---|---|---|---|---|
| 4,212,393 | A | | 7/1980 | Lenkoff | |
| 4,566,721 | A | | 1/1986 | Friedman et al. | |
| 4,613,525 | A | | 9/1986 | Miyamoto et al. | |
| 4,629,349 | A | | 12/1986 | Pitts | |
| 4,943,088 | A | | 7/1990 | Wada | |
| 5,029,899 | A | | 7/1991 | Schieppati et al. | |
| 5,030,027 | A | * | 7/1991 | Bachrach et al. | 402/4 |
| 5,100,181 | A | | 3/1992 | Nathans et al. | |
| 5,196,237 | A | | 3/1993 | May | |
| 5,219,437 | A | * | 6/1993 | Moor et al. | 281/29 |
| 5,255,834 | A | * | 10/1993 | Bendersky | 224/209 |
| D343,862 | S | * | 2/1994 | Wyant | D19/26 |
| 5,372,506 | A | | 12/1994 | Hambright | |
| 5,468,553 | A | | 11/1995 | Koike et al. | |
| 5,472,239 | A | | 12/1995 | Trujillo | |
| 5,494,733 | A | | 2/1996 | Koike et al. | |
| 5,518,764 | A | | 5/1996 | Trübel et al. | |
| 5,698,478 | A | | 12/1997 | Yamamoto et al. | |
| 5,711,627 | A | | 1/1998 | Chapman | |
| 5,722,694 | A | | 3/1998 | Baldursson | |
| 5,799,978 | A | | 9/1998 | Grinnell | |
| 5,853,859 | A | | 12/1998 | Levy et al. | |
| 5,857,797 | A | | 1/1999 | Streff et al. | |
| 5,876,143 | A | | 3/1999 | Ong | |
| 5,890,774 | A | | 4/1999 | Schwartz et al. | |
| 5,891,811 | A | | 4/1999 | Ashida et al. | |
| 5,931,505 | A | | 8/1999 | Malpass et al. | |
| D419,186 | S | | 1/2000 | Moor | |
| 6,017,164 | A | | 1/2000 | Abbott | |
| 6,030,140 | A | | 2/2000 | Karten et al. | |
| 6,061,943 | A | * | 5/2000 | Pepys | 40/771 |
| 6,132,059 | A | * | 10/2000 | Leibowitz | 362/156 |
| 6,139,210 | A | * | 10/2000 | Nelson et al. | 402/79 |
| 6,165,593 | A | * | 12/2000 | Brault et al. | 428/195 |
| 6,176,910 | B1 | * | 1/2001 | Miyazaki et al. | 106/31.36 |
| 6,182,571 | B1 | * | 2/2001 | Jolliffe et al. | 101/465 |
| 6,193,118 | B1 | * | 2/2001 | Kearl | 224/153 |
| 6,194,077 | B1 | * | 2/2001 | Yuan et al. | 428/478.2 |
| 6,316,081 | B1 | * | 11/2001 | Nelson et al. | 428/195 |
| 6,367,842 | B1 | * | 4/2002 | Wien et al. | 281/37 |
| 6,450,633 | B1 | * | 9/2002 | Kronzer | 347/105 |
| 2002/0056380 | A1 | * | 5/2002 | Wien et al. | 101/128.21 |
| 2003/0016280 | A1 | * | 1/2003 | Li et al. | 347/106 |
| 2003/0035932 | A1 | * | 2/2003 | Yamamoto et al. | 428/195 |
| 2003/0044559 | A1 | * | 3/2003 | Liu et al. | 428/40.1 |

* cited by examiner

FIG. 4
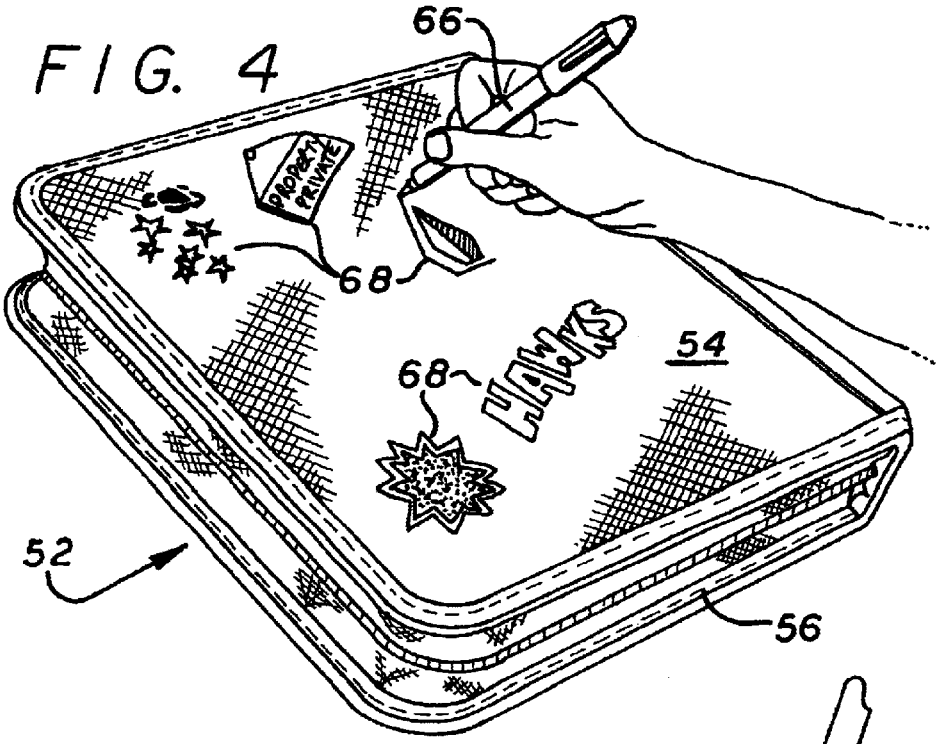
FIG. 5
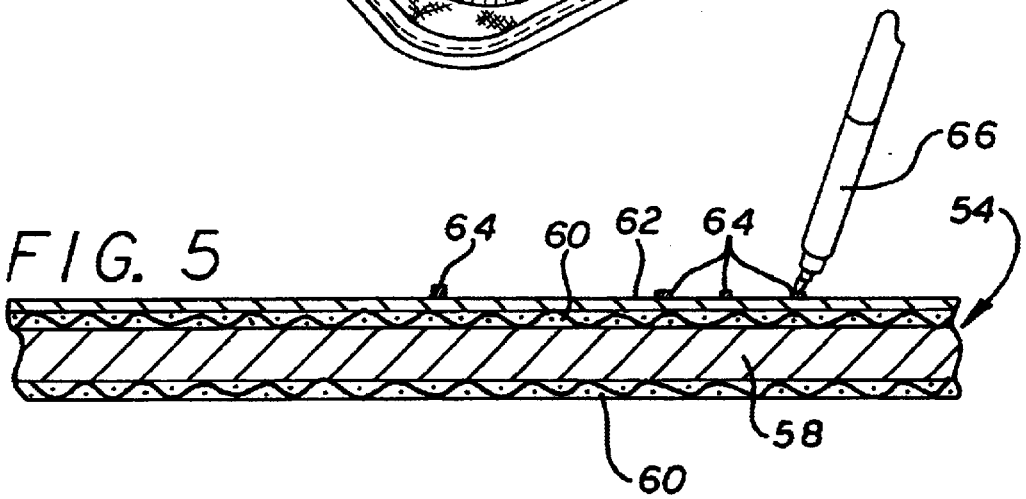
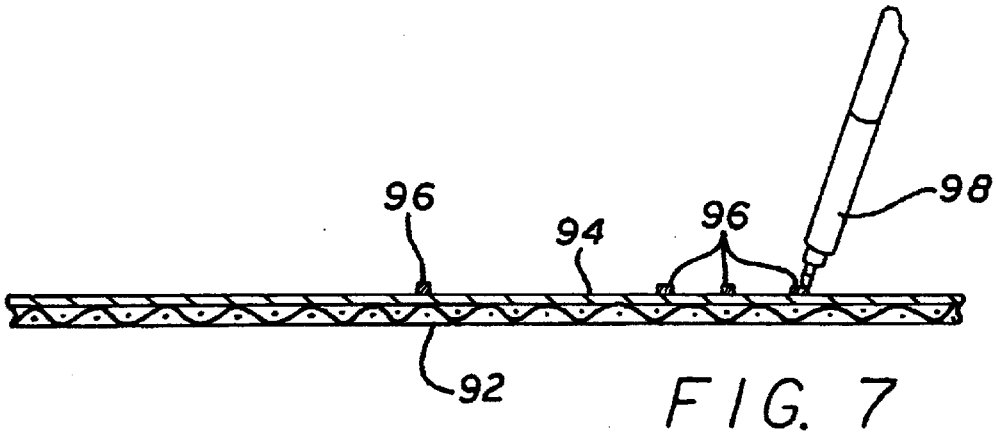
FIG. 7

DRAWABLE AND/OR TRACEABLE CARRIERS

RELATED APPLICATION

This application is a continuation-in-part of U.S. patent application Ser. No. 09/607,996 filed Jun. 30, 2000.

FIELD OF THE INVENTION

This invention relates to personalized binders, or albums, and fabric covered carriers.

BACKGROUND OF THE INVENTION

It has previously been proposed to make three ring binders, for example, with transparent pockets on the cover thereof into which personal visual material may be inserted. Examples of this type of binder are shown in U.S. Pat. No. 5,857,797, granted Jan. 12, 1999; U.S. Pat. Des. No. 417, 890, granted Dec. 21, 1999; and U.S. Pat. Des. No. 421,460, granted Mar. 7, 2000.

However, in addition to personal visual material, such as photographs, or the like, it would be desirable to be able to add permanent ink images or writing onto the binder covers; and this has not been practical up to the present because the plastic binder covers will not accept all types of ink, some inks will wipe off, and high humidity or moisture will often cause the ink to run or spread. A similar problem involves photo albums and the transparent sheet material overlying the photographs, as this sheet material does not readily accept applied ink indicia. Regarding fabric covered binders, backpacks or other carriers, it has normally not been practical to draw with ink onto such fabric covered binders or carriers, as the ink is absorbed into the fabric.

SUMMARY OF THE INVENTION

In accordance with one specific illustrative embodiment of the invention, a binder is provided with a transparent plastic sheet over the binder cover, in the form of a pocket into which visual material may be inserted, and the transparent sheet is provided with an ink receptive coating or layer receptive to solvent based ink, aqueous ink or gel based ink, and which is substantially water-fast following drying of the applied ink. This construction permits users to write or draw on the binder or to trace visual material which is inserted into the pocket. In addition, the user may insert visual material into the pocket, and add written or pictorial images to the visual material, to provide a composite image on a personalized binder.

From a broader perspective, an assembly for holding papers and having front and rear covers may be provided with a coating or layer, which is receptive to aqueous, solvent based or gel inks, and which is substantially water-fast following drying of the ink. The user may then draw on the cover with any type of pen and personalize the binder with any desired printing or images. The coating may be on the inside and/or outside of either or both covers. In the case of dark fabric covered three ring binders, for example, the coating will permit ink personalization of the binders where an uncoated fabric covered binder would merely absorb the ink with little residual image.

In accordance with another aspect of the invention, fabric covered carriers, such as cloth covered binders, or backpacks often used to carry books or binders with stacks of sheets of paper or pages may be specially coated with special ink receptive coatings which are also substantially water fast following drying. Subsequently the products may be personalized by drawing or writing on them with pen and ink.

In addition, the covers and pages of photo albums may be provided with ink receptive coatings for personalization of the covers and individual photos.

Other objects, features and advantages of the invention will become apparent from a consideration of the associated drawings and from the following detailed description.

BRIEF DESCRIPTIONS OF THE DRAWINGS

FIG. 4 is a perspective view of a personalized cloth covered ring binder illustrating one aspect of the invention;

FIG. 5 is a cross-sectional view through one cover of the ring binder of FIG. 4 showing drawing with a pen on the coated cover with an ink pen;

FIG. 7 is a cross-sectional view through one of the walls of the backpack of FIG. 6.

DETAILED DESCRIPTION OF THE PREFERRED EMBODIMENTS

Figure 1:
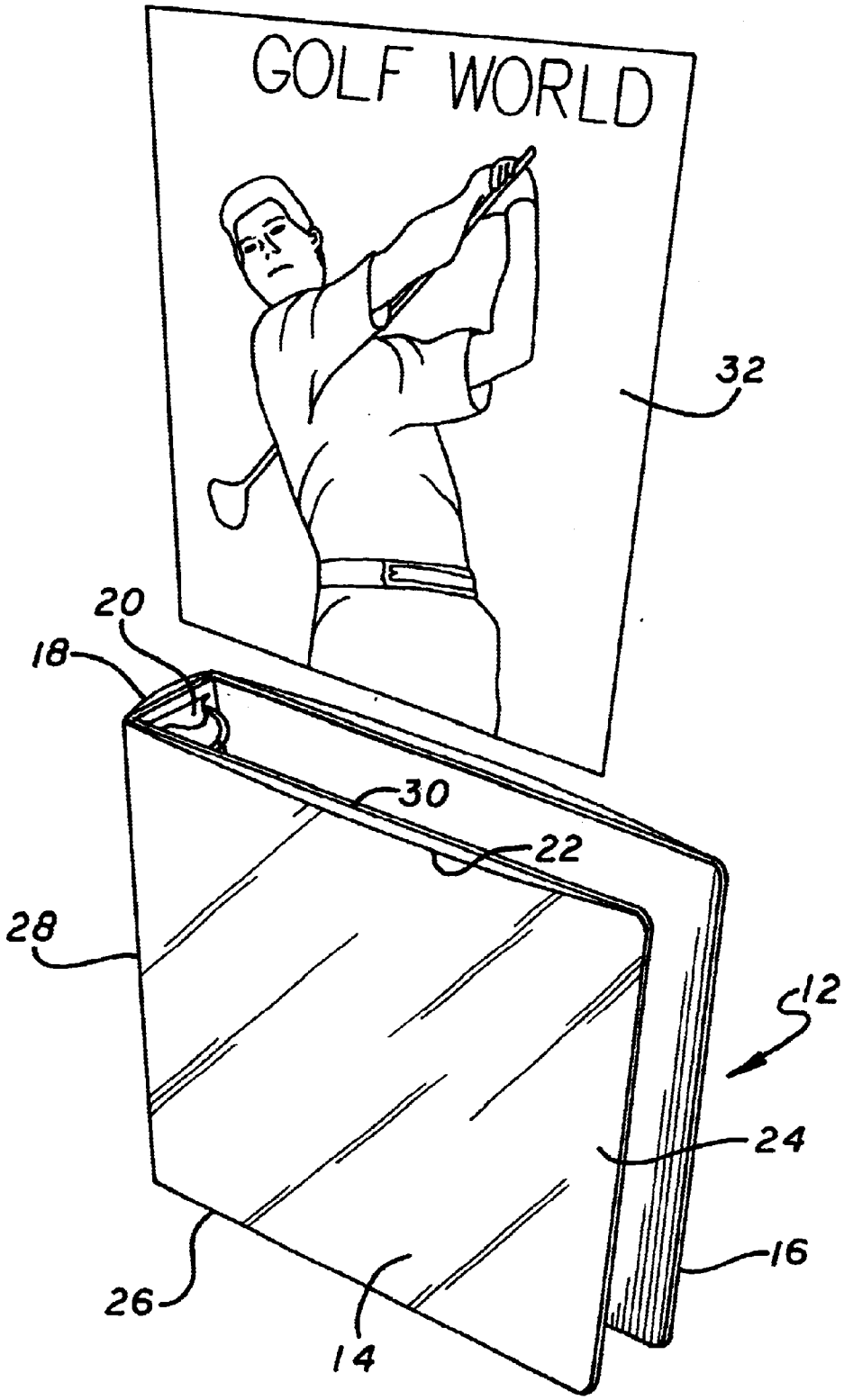
FIG. 1 shows a three ring binder with a transparent pocket on the cover thereof and a visual insert for the pocket.

Referring more particularly to the drawings, FIG. 1 shows a three ring binder 12 having a front cover 14, a rear cover 16, and a spine 18, with a ring assembly 20 mounted on the spine 18 to receive papers. Secured to the front cover 14 is a transparent or translucent plastic sheet 22, provided with an outer ink receptive coating as discussed below. The sheet 22 is secured to the front cover 14 at the right hand edge 24, at the bottom 26, and optionally at the left hand edge 28 near the spine 18. The sheet 22 is open at the top edge 30 of the front cover of the binder, to provide a pocket into which visual material 32 may be inserted.

Figure 2:
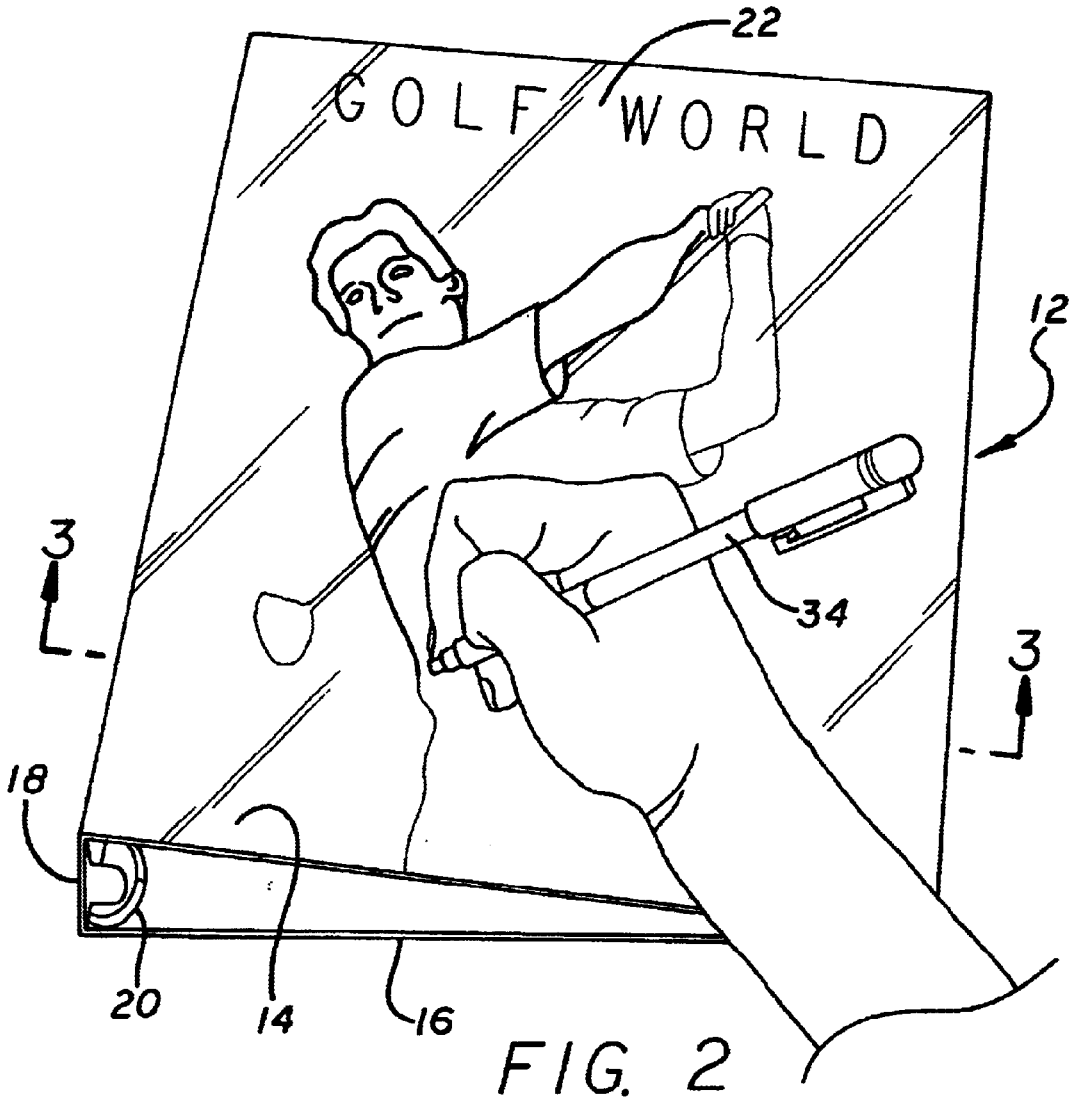
FIG. 2 shows the binder of FIG. 1 with the visual insert in the pocket, and with the user tracing a portion of the insert onto a special ink receptive layer or coating on the outer surface of the pocket.

FIG. 2 shows the visual material within the pocket formed by the plastic sheet 22, on the front cover 14 of the binder. The user is using a pen 34 to trace a portion of the image from the visual material onto a special layer or coating on sheet 22 on the cover of the binder.

Figure 3:
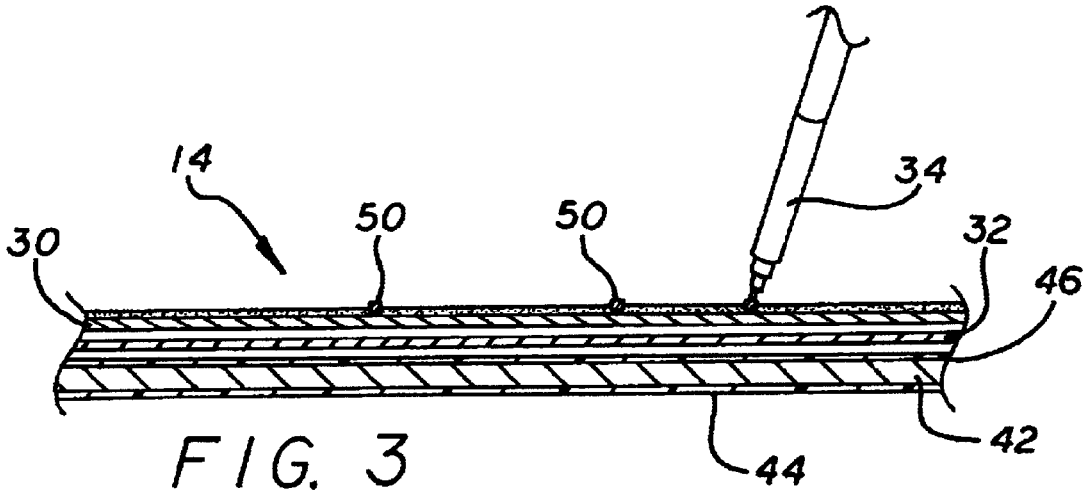
FIG. 3 is a cross-sectional view taken along line 3—3 of FIG. 2 showing the binder cover, the pocket, the insert, and the outer ink receptive layer.

FIG. 3 is a schematic cross-sectional view of a portion of the front cover 14 of the binder, taken along line 3—3 of FIG. 2. In FIG. 3, the front cover 14 includes an inner fairly stiff base member 42, covering layers 44 and 46, which may be formed of plastic or cloth, for examples, and the visual insert 32. The transparent or translucent plastic sheet 22 which forms the pocket, has an outer ink receptive coating or layer 48. Ink 50 which has just been applied to the coating is shown at several points on and in the layer 48.

Concerning the layer 48 which is receptive to aqueous, solvent based and gel based ink, the ink is also substantially water-fast once it has dried. One coating which has been successfully employed is disclosed in PCT Publication Number WO 99/04981, entitled "Ink Receptive Coatings and Coated Products." This coating includes a pigment disposed in or mixed with a binder which may be an ethylene-vinyl acetate emulsion polymer and a water soluble cationic polymer. Other combinations of hydrophobic and water soluble materials may be used. The foregoing coating may be translucent, permitting tracing through the coating and with very finely divided pigments it may be virtually transparent. Other coatings which are receptive to all three types of ink and which are substantially water-fast are disclosed in U.S. Pat. No. 4,613,525, granted Sep. 23, 1986; European Patent Application No. 0 199 874, published Nov. 5, 1986; PCT Publication No. WO 97/01448, published Jan. 16, 1997; European Patent Specification EP 0 655 346B 1, published May 31, 1995; and PCT Publication No. WO 96/18496, published Jun. 20, 1996. These references generally relate to coatings for use with sheets used with ink jet printers, with the ink jet printers applying the water based ink to individual sheets of coated paper which may be fed one by one through the printers.

Concerning the coating, it advantageously includes a porous pigment such as silica gel, in a binder which permits penetration by water based ink, gel inks, or solvent based inks. In order to permit penetration by the ink, the coating may have the particulate material in substantial quantity such that at least some of the pigment or particulate material is at or immediately adjacent the surface of the coating. The coating may include as components both hydrophobic material and a water soluble polymer. The water soluble polymer may be present in a significant amount such as 5% to 50% of the binder. When a water soluble polymer is employed, it is believed that the ink is absorbed into the coating via the soluble polymer and penetrates the pores of the pigment, thus producing a clear image wherein the carrier for the ink (water, gel or solvent) brings the ink color to penetrate the pores of the finely divided pigment of the coating.

Another coating binder which has been successfully employed is available from Raffi and Swanson of Boston, Mass. under the designation AC-491. Particulate material such as carbon black, talc, calcium oxide or silica is added to the binder. It is understood that this material may include a substantial or a major proportion of a an acrylic polymer which is hydrophobic such as acrylonitrile.

The transparent or translucent sheet 22 may be secured at three edges to the cover 14 of the binder and may be open at the top at edge 30, for example, or adjacent to the spine. If desired, the transparent plastic material and associated ink receptive layer may be provided at the spine 18 and on the rear cover 16, as shown in FIG. 1 of the drawings. This can involve three separate pockets each open only at the top, a pocket extending over the front cover and the spine and secured to the binder at the back of the spine, or one big pocket secured to the binder only along the lower edge of the binder and at the edges of the front and rear covers away from the binder spine.

In the foregoing detailed description and in the accompanying drawings, a three ring binder was shown which had a transparent or translucent pocket on the front cover thereof. In some cases, using the preferred coating disclosed in PCT Publication No. 99/04981, the coated film may be translucent and not fully transparent. However, with the visual material in the pocket and directly adjacent to the coated film, it is clear enough to be easily traceable. Further, by using very fine pigment particles, the transparency of the coating may be increased.

Referring now to FIGS. 4 and 5 of the drawings, they show a cloth covered three ring binder 52 with first and second covers 54 and 56. Either or both of the covers 54 and 56 may be provided with the central stiff sheet member 58 covered with cloth 60. One or both of the fabric or cloth layers 60 may be provided with an additional layer 62 of material as discussed above which is receptive to water based ink, solvent based ink, or gel ink, and which is substantially water fast. In FIG. 5, the ink 64 is shown being applied to the layer 62 by the pen 66. The images 68 shown in FIG. 4, which have been drawn by the pen 66, serve to personalize the notebook 52 and make it uniquely identifiable as well as expressive of the personality of the owner.

Figure 6:
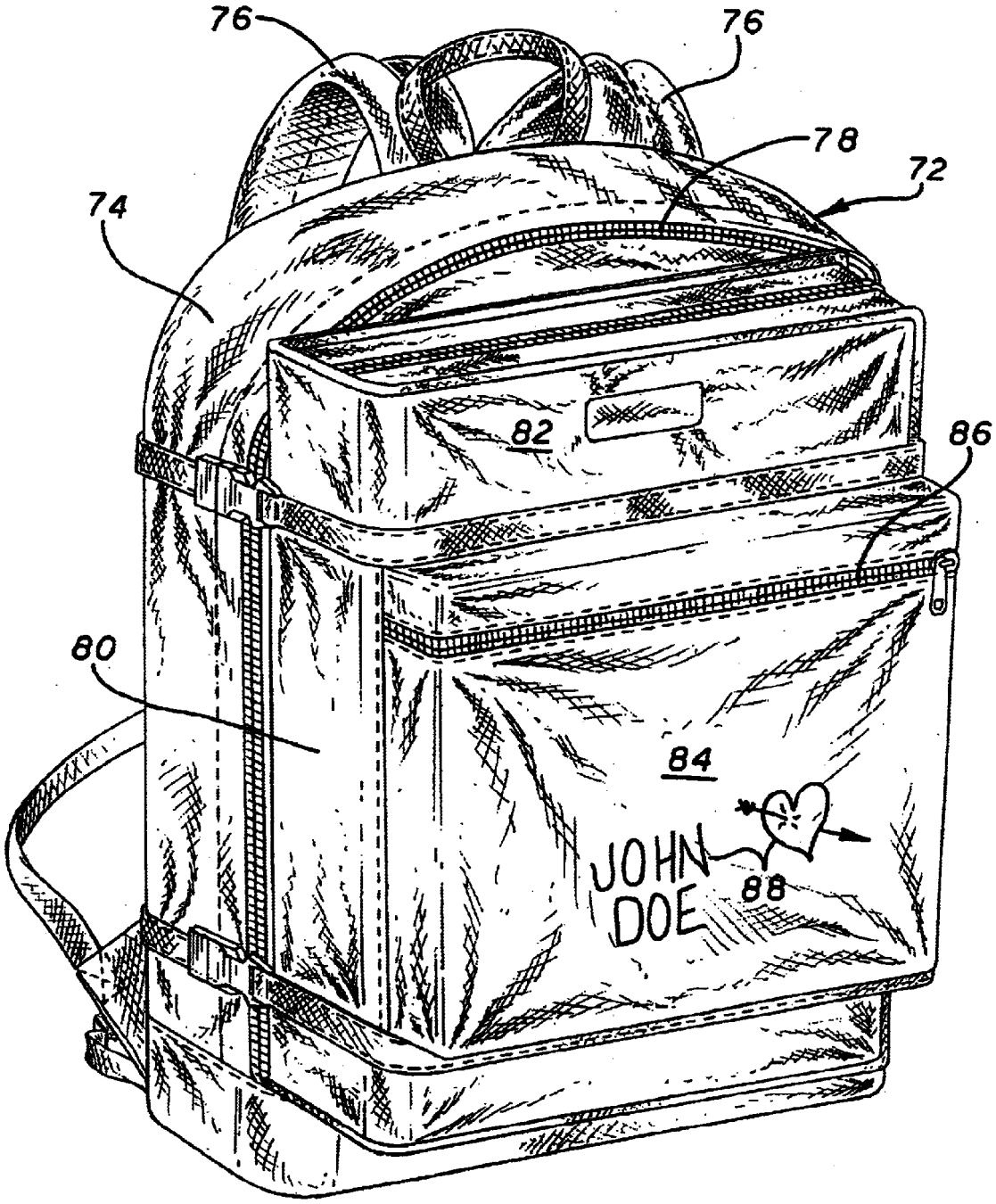
FIG. 6 is a perspective view of a backpack illustrating one aspect of the invention.

Referring now to FIG. 6 of the drawings it shows a backpack 72, including a main storage compartment 74, and straps 76 for holding the backpack over the shoulders of the user. The main storage compartment 74 may be provided with a zipper 78 permitting access to the main storage area. A supplemental compartment 80 may be provided which is sized to closely receive a zippered three ring binder 82. An additional smaller compartment 84 may also be provided for receiving small objects such as pens, pencils, keys or the like. The zipper 86 gives access to compartment 84.

The entire backpack 72 or only selected access such as the outwardly facing frontage of compartment 84 may be coated with one of the ink-receptive, substantially water fast coatings as identified hereinabove. Personalized indicia such as signatures or symbols may be applied by pen and ink onto the coated areas of the backpack as indicated at reference numeral 88 in FIG. 6. FIG. 7 is a schematic cross-sectional view through one area of the outer fabric of the backpack 72 shown in FIG. 6 of the drawings. More specifically, the fabric 92 has an outer coating 94 applied thereto, with the coating being of the ink receptive, substantially water fast type as identified hereinabove. Ink writing or drawing is shown at reference numeral 96, with the ink being applied by the pen 98.

Another carrier to which the ink receptive coating may be applied is a pencil pouch. The pencil pouch would have three reinforced holes for securing in a three ring binder and would be a separate fabric material pocket or pouch with a zipper or a hook-and-loop type closure for permitting access to the pencils, pens or other small objects within the pencil pouch. The ink receptive coating could be on both or only one side of the pencil pouch.

It is further noted that, instead of three ring binders, the present invention is applicable to other binders for holding papers, such as binders with multiple rings or other arrangements for holding papers, including albums, folders, portfolios, multiple layer sheet protectors or report covers; and these may be provided with the additional pocket for receiving papers to be traced or displayed as discussed hereinabove for the three ring binder embodiment. Also, the coating may be applied to fabric covered binders or to plastic covered binders without a transparent cover pocket. Relative to fabric covered binders, inks applied by pen would normally be absorbed into the fabric and would not stand out prominently; however following coating, any desired image may be applied using solvent based ink, water based ink or gel pens, and the image is clear and prominent on the coated surface of the fabric binders. By coating backpacks or dark binders, either cloth covered or plastic covered, images may be penned onto the coatings using pastel inks and/or metallic gel inks, to provide a bright and colorful display. The inside surface of binder covers may also be coated, and provided with transparent or translucent inner pockets subject to pen and ink tracing and drawing. It is also noted that the ink receptive layer may be initially embodied in a separate sheet which is laminated to the transparent or translucent sheet 30 as shown in FIGS. 1–3 of the drawings. It is further noted that the sheet 30 may be formed of vinyl, polypropylene, or any other suitable plastic. Also, the particulate material may be in the form of colored pigments, of any desired color, or white, or black. In addition, the front cover may be formed of a fairly heavy gauge plastic instead of the three layers 42, 44, and 46 as shown in FIG. 3 of the drawings. It is also noted that the carriers may be opened and securely closed using Velcro-type hook and loop fasteners, snaps or clips, for example. Accordingly, the present invention is not limited to the precise embodiment shown in the drawings and described in detail hereinabove.

What is claimed is:

1. In combination:

a fabric covered three dimensional carrier;

a coating on a substantial area of said carrier, said coating being receptive to all of (1) water based ink, (2) solvent based ink and (3) gel based ink; said coating being substantially water fast following the application of ink; said coating including porous particulates and some water soluble material; and a permanent visual image in said ink prominently displayed on said coated fabric following application of said image by said ink.

2. A fabric covered three dimensional carrier as defined in claim 1 wherein said carrier is a three ring binder.

3. A fabric covered three dimensional carrier as defined in claim 1 wherein said carrier is a backpack.

4. A fabric covered three dimensional carrier as defined in claim 1 wherein said carrier is a photo album.

5. A fabric covered three dimensional carrier as defined in claim 1 wherein said coating includes substantial proportions of both hydrophobic and hydrophilic material.

6. A fabric covered three dimensional carrier as defined in claim 1 wherein said carrier includes a selectively closable inner space.

7. A method for personalizing three dimensional fabric covered carriers such as cloth covered notebooks, albums or backpacks comprising the steps of:

assembling a three dimensional carrier with the carrier having an external fabric surface, the carrier having internal space for holding papers or other loads, and arrangements for selectively closing the inner space;

applying to the fabric a layer of material which is receptive to water based ink, gel ink and solvent based ink; the 112 layer of material being substantially water fast following application of ink; and the layer of material including finely divided porous particulates and a binder including a substantial proportion of hydrophobic material and 5% to 50% of a water soluble polymer;

personalizing the carrier by writing or drawing on the layer using an ink pen; and the ink providing a bright contrasting image on the outer surface of the carrier;

whereby the owner of said carrier may personalize and uniquely identify the imaged carrier.

8. A method as defined in claim 7 wherein the applying step is limited to application to a selected limited area of said carrier.

9. In combination:

a fabric covered three dimensional carrier;

a coating on a substantial area of said carrier, said coating being receptive to water based ink, solvent based ink and gel based ink; said coating being substantially water fast following the application of ink;

said coating including finely divided particulate material and a binder including substantial portions of water soluble and hydrophobic material; and a visual image in said ink prominently displayed on said coated fabric following application of said image by said ink.

10. A fabric covered three dimensional carrier as defined in claim 9 wherein said carrier is a three ring binder.

11. A fabric covered three dimensional carrier as defined in claim 9 wherein said carrier is a backpack.

12. A fabric covered three dimensional carrier as defined in claim 9 wherein said carrier is a photo album.

13. A fabric covered three dimensional carrier as defined in claim 9 wherein said carrier includes a selectively closable inner space.

14. A method for personalizing three dimensional fabric covered carriers including cloth covered notebooks, albums or backpacks comprising the steps of:

assembling a three dimensional carrier with said carrier having an external fabric surface;

applying to said fabric only a single coating, said coating being a material which is receptive to water based ink, gel ink and solvent based ink; said coating being substantially water fast and the images permanent following application of ink;

said coating being formed to include finely divided porous particulates and a binder including some hydrophobic material; and a water soluble polymer, permitting ink to penetrate to into the porous particulates; and the application of said ink providing a bright contrasting image on the outer surface of said carrier when applied;

whereby the owner of said carrier may personalize and uniquely identify the imaged carrier.

15. A method as defined in claim 14 wherein the applying step is limited to application to a selected limited area of said carrier.

16. A method as defined in claim 14 further including the step of writing on said layer using pens having at least two different types of ink.

17. In combination:

a fabric covered three dimensional carrier;

a coating on a substantial area of said carrier, said coating being receptive to water based ink, solvent based ink and gel based ink; said coating being substantially water fast and the images permanent following the application of ink; said coating including finely divided porous particulates, and a binder including a substantial proportion of hydrophobic material;

said coating permitting flow of said ink into said coating to said particulate material; and a visual image in said ink prominently displayed on said coated fabric following application of said image by said ink.

18. A carrier as defined in claim 17 wherein said coating includes water soluble material.

19. A fabric covered three dimensional carrier as defined in claim 17 wherein said binder includes substantial proportions of hydrophobic and hydrophilic material.

20. A fabric covered three dimensional carrier as defined in claim 17 wherein said carrier includes a selectively closable inner space.

21. A method for personalizing a binder:

assembling a ring binder, with said binder having an external fabric surface; and a ring structure for holding pages in said binder;

applying to said fabric a coating, which is receptive to water based ink, gel ink and solvent based ink; said coating being substantially water fast and the images permanent following application of ink; with said coating including finely divided porous particulates and a binder including some hydrophobic material; and 5% to 50% of a water soluble polymer;

writing or drawing on said coating with a pen containing ink of a predetermined type; having a bright contrasting color relative to the coated fabric, to provide a bright contrasting image on the outer surface of said binder;

whereby the owner of said binder may personalize and uniquely identify the coated binder.

22. A method as defined in claim 21 including the step of writing on the coated fabric with a second pen containing a different type of ink from said predetermined type of ink.

23. A method as defined in claim 21 wherein the applying steps employs a binder which includes some water soluble material.

24. A method for personalizing three dimensional fabric covered carriers including cloth covered notebooks, albums or backpacks comprising the steps of:

assembling a three dimensional carrier with said carrier having an external fabric surface;

applying to said fabric a layer of material which is receptive to water based ink, gel ink and solvent based ink; said layer of material being substantially water fast and the images permanent following application of ink;

writing or drawing on said material with a pen containing ink of a predetermined type having a bright contrasting color relative to the coated fabric;

the application of said ink providing a bright contrasting image on the outer surface of said carrier when applied; and blocking the flow and diffusions of ink into the fabric by the use of said layer of adequate thickness so that the ink does not penetrate into said fabric;

whereby the owner of said carrier may personalize and uniquely identify the imaged carrier.

25. A method as defined in claim 24 including the step of writing on the coated fabric with a second pen containing a different type of ink from said predetermined type of ink.

26. A method as defined in claim 24 wherein the applying step employs a binder which includes some finely divided porous particulate material, some hydrophobic material and 5% to 50% of some water soluble material.

27. A method for personalizing three dimensional fabric covered carriers including cloth covered notebooks, albums or backpacks comprising the steps of:

assembling a three dimensional carrier with the carrier having an external fabric surface;

applying to the fabric a layer of material which is receptive to water based ink, gel ink and solvent based ink; the layer of material being substantially water fast and the images permanent following application of ink;

writing or drawing on the layer of material with a pen containing ink of a predetermined type having a bright contrasting color relative to the coated fabric;

the application of the ink providing a bright contrasting image on the outer surface of the carrier when applied;

blocking the flow and diffusions of ink into the fabric by the use of the layer of adequate thickness so that the ink does not penetrate into the fabric; and the applying step employing a binder including finely divided porous particulate material, hydrophobic material and 5% to 50% of a water soluble material, wherein the water soluble material permits ink to penetrate into the pores of the porous particulate material; and the combination of the hydrophobic material and the ink penetration into the pores of the particulate material makes the image waterfast;

whereby the owner of the carrier may personalize and uniquely identify the imaged carrier.

* * * * *